US011969037B2

(12) United States Patent
Zhao et al.

(10) Patent No.: US 11,969,037 B2
(45) Date of Patent: Apr. 30, 2024

(54) ANTI-IMPACT GLOVES

(71) Applicant: SHANGHAI SELECT SAFETY PRODUCTS CO., LTD., Shanghai (CN)

(72) Inventors: Wei Zhao, Shanghai (CN); Jason Leigh Sparrow, Shanghai (CN); Xiuyun Zhang, Shanghai (CN); Xuefeng Yan, Shanghai (CN)

(73) Assignee: Shanghai Select Safety Products Co., Ltd. (CN)

( * ) Notice: Subject to any disclaimer, the term of this patent is extended or adjusted under 35 U.S.C. 154(b) by 106 days.

(21) Appl. No.: 17/624,066

(22) PCT Filed: Dec. 30, 2019

(86) PCT No.: PCT/CN2019/129946

§ 371 (c)(1),
(2) Date: Dec. 30, 2021

(87) PCT Pub. No.: WO2021/036144

PCT Pub. Date: Mar. 4, 2021

(65) Prior Publication Data

US 2022/0354198 A1 Nov. 10, 2022

(30) Foreign Application Priority Data

Aug. 30, 2019 (CN) ..... 201921434265.7

(51) Int. Cl.
*A41D 19/015* (2006.01)

(52) U.S. Cl.
CPC ..... *A41D 19/01523* (2013.01)

(58) Field of Classification Search
CPC ..... A41D 19/0523; A41D 19/015; A41D 19/01517; A41D 19/01505
See application file for complete search history.

(56) References Cited

U.S. PATENT DOCUMENTS 3,404,409 A * 10/1968 Tillotson ..... A41D 19/01547 2/167
4,570,269 A * 2/1986 Berlese ..... A41D 19/01523 D29/117.1

(Continued)

FOREIGN PATENT DOCUMENTS

CN 202664338 U 1/2013
CN 203986255 U 12/2014

(Continued)

OTHER PUBLICATIONS

International Search Report for PCT/CN2019/129946 dated May 20, 2020.

*Primary Examiner* — F Griffin Hall
(74) *Attorney, Agent, or Firm* — Kramer Levin Naftalis & Frankel LLP

(57) ABSTRACT

The present application discloses anti-impact gloves, which include a glove body and an anti-impact protective layer arranged on the back of the glove body. The anti-impact protective layer includes a finger protection layer, which includes a thumb protective layer and a plurality of universal finger protective layers; an anisotropic flex slit is arranged on the first dactylus of the thumb protective layer near the first knuckle, and a flex cut structure is provided at the metacarpophalangeal joint. A plurality of full flex cuts are positioned at the fingertip part of each universal finger protective layer; the hand back protective layer includes a plurality of vertical protection blocks and a plurality of long strip-shaped flex slits arranged alternately; the bottom layer is fixed on the back of the glove body. The anti-impact gloves of the present application can buffer an external impact force, and a finger protection layer adapted to the corresponding finger is set according to the shape and movement law of each finger, which not only protects the (Continued)

finger in all directions but also ensures the free movement of the finger.

11 Claims, 5 Drawing Sheets

(56) References Cited

U.S. PATENT DOCUMENTS

| | | | | |
|---|---|---|---|---|
| 8,479,318 | B2 * | 7/2013 | Kim | A63B 71/143 2/160 |
| D722,208 | S * | 2/2015 | Votel | D29/117.1 |
| 9,629,402 | B2 * | 4/2017 | Albertyn | A41D 19/01505 |
| D796,779 | S * | 9/2017 | Votel | D29/117.1 |
| D849,358 | S * | 5/2019 | Votel | D2/617 |
| 10,342,274 | B2 * | 7/2019 | Lim | A41D 19/01505 |
| D858,895 | S * | 9/2019 | Lim | D2/617 |
| 10,405,592 | B2 * | 9/2019 | Kim | A41D 19/01523 |
| 10,506,836 | B2 * | 12/2019 | Takagi | A41D 13/0156 |
| 10,701,993 | B2 * | 7/2020 | Lim | A41D 19/01523 |
| 10,993,488 | B1 * | 5/2021 | Chou | B32B 9/025 |
| 2004/0025226 | A1 * | 2/2004 | Jaeger | A41D 19/01558 2/161.6 |
| 2010/0071114 | A1 * | 3/2010 | Jaeger | A41D 19/01523 2/163 |
| 2014/0033392 | A1 * | 2/2014 | Bulan | A41D 19/01547 2/16 |
| 2014/0137305 | A1 * | 5/2014 | Fisher | A41D 31/28 2/20 |
| 2017/0072287 | A1 | 3/2017 | Gait et al. | |
| 2017/0295869 | A1 * | 10/2017 | Choi | A41D 19/01523 |
| 2018/0303176 | A1 * | 10/2018 | Lim | A41D 19/01505 |

FOREIGN PATENT DOCUMENTS

| | | | |
|---|---|---|---|
| CN | 206165898 | U | 5/2017 |
| CN | 206978843 | U | 2/2018 |
| CN | 207383620 | U | 5/2018 |
| CN | 208972721 | U | 6/2019 |
| WO | WO-2017053818 | A1 * | 3/2017 |

* cited by examiner

ANTI-IMPACT GLOVES

This present application claims priority from PCT/CN2019/129946 filed on Dec. 30, 2019, which claims priority from Chinese Application 201921434265.7, filed on Aug. 30, 2019, the entire disclosure of each of which is hereby incorporated by reference

FIELD OF THE INVENTION

The present application relates to the technical field of gloves, in particular to anti-impact gloves.

BACKGROUND OF THE INVENTION

The tissues, knuckles, nails and bones of the hand back of the human are relatively fragile parts. When workers carry out certain operations in the harsh outdoor environment or people perform certain outdoor sports, the hand back is vulnerable to external impact, resulting in trauma to the hand back. Therefore, it is urgent to develop a kind of anti-impact gloves that can not only cushion the external impact, but also ensure that the fingers can bend freely. The existing protective gloves achieve the purpose of protection by providing a protective layer on the back of the palm. However, due to the unreasonable structure of the protective layer, the hand back cannot be fully protected, especially the nails and related joints cannot be effectively protected, and some protective gloves will cause the fingers to have a sense of restraint, such that the fingers cannot move flexibly.

After searching the prior art literature, it is found that the Chinese patent No. CN203986255U discloses multifunctional gloves. The gloves include a glove body comprising a finger part, a palm part, a hand back part and a wrist part. An abrasion-resistant layer is sewn on the front of the finger part and the palm part. The surface of the abrasion-resistant layer is pasted with a friction sheet. A rubber strip is attached to the back of each finger part of the glove body, and the joint part of the hand back has a three-layer structure, which is composed of a sponge layer, a nylon layer and a rubber protective layer from the inside to the outside. The nylon layer is sutured with the back part of the hand, and the sponge layer is wrapped between the nylon layer and the back part of the hand. The rubber protective layer is adhered to the nylon layer, and a rubber cushion is attached to the back part of the hand. The abrasion-resistant layer is respectively provided with an opening for finger bending at the corresponding finger joint positions, and a cut is disposed at the middle position of the corresponding palm on the abrasion-resistant layer for palm bending. The multifunctional gloves in CN203986255U can reduce the impact force, but the requirements of flexibility of fingers cannot be met only by setting openings and cuts on the protective layer of gloves, and the protection of thumb part only involves the fingertip part, and the metacarpophalangeal joint which is easy to be damaged cannot be effectively protected.

SUMMARY OF THE INVENTION

In view of the shortcomings in the prior art, the purpose of the present application is to provide anti-impact gloves, wherein the back of the anti-impact glove is provided with an anti-impact protective layer which can reduce the external impact force, and according to the shape and activity law of each finger, equipped with a finger protection layer adapted for the corresponding fingers, which not only protects the fingers in all directions but also ensures the free movement of the fingers.

The present application provides anti-impact gloves, comprising a glove body and an anti-impact protective layer arranged on a back of the glove body, wherein the anti-impact protective layer includes:

- a finger protective layer, which comprises a thumb protective layer and a plurality of universal finger protective layers, wherein the thumb protective layer covers a thumb part on the back of the glove body and extends above the thumb metacarpophalangeal joint, an anisotropic flex slit is arranged on the first dactylus of the thumb protective layer near the first knuckle, and a flex cut structure is provided at the metacarpophalangeal joint of the thumb protection layer to adapt to the bending of the metacarpophalangeal joint;
- the plurality of universal finger protective layers, respectively covered on other finger parts except the thumb and adapted to the corresponding finger shape, wherein a fingertip part of each universal finger protection layer is provided with a plurality of full flex cuts to divide the fingertip part into a plurality of partition blocks facing different directions;
- a hand back protective layer, arranged on a hand back part of the back of the glove body and including a plurality of vertical protection blocks and a plurality of long strip-shaped flex slits arranged alternately, each of the long strip-shaped flex slits is distributed between the two adjacent metacarpophalangeal joints;
- a bottom layer disposed below the finger protective layer and the hand back protective layer and fixed on the back of the glove body.

Preferably, the flex slit is a V-shaped structure with a wide top and a narrow bottom, and the flex slit penetrates the anti-impact protective layer at a corresponding position.

Preferably, the flex cut structure comprises two half flex cuts arranged at lateral intervals and a full flex cut positioned between the two half flex cuts.

Preferably, the anisotropic flex slit (20) is in the shape of a "Y-shaped", "X-shaped", "cross-shaped" or "UK-flag shaped".

Preferably, two full flex cuts are arranged transversely at the first knuckle of the universal finger protective layer, the flex cut structure is arranged at the second knuckle, and a long strip-shaped full flex cut is arranged in the direction extending from the vicinity of the first knuckle to the hand back.

Preferably, the vertical protection block is of long strip structure, and two half flex cuts are provided laterally spaced apart on the vertical protection block, and a full flex cut is disposed between the two half flex cuts.

Preferably, a detail cut is optionally disposed between the half flex cut and the full flex cut of the vertical protection block and the adjacent flex slit.

Preferably, the full flex cut, the half flex cut and the detail cut extend downward from the top of the anti-impact protective layer, the depth of the full flex cut is equal to or less than the thickness of the finger protective layer or the hand back protective layer at the corresponding position, and the depth of the half flex cut is less than that of the corresponding full flex cut and greater than that of the corresponding detail cut.

Preferably, an anti-split rim is provided on a periphery of the flex slit, and the anti-split rim protrudes from the end face of the anti-impact protective layer.

Preferably, the periphery of the thumb protective layer, the universal finger protection layer and the hand back protective layer, and the side edges of the full flex cut and the half flex cut are a slope inclined to the bottom layer; and a wiring track for stitching is provided between the periphery of the bottom layer with the finger protection layer and the hand back protective layer, and preferably, the bottom layer is a honeycomb mesh structure.

The Beneficial Effects of the Patent Application are as Follows.

In the present application, a thumb protective layer is disposed on the glove, the thumb protective layer covers the thumb part on the back of the glove body and extends above the thumb metacarpophalangeal joint to protect the metacarpophalangeal joint of the thumb, so as to realize the full coverage protection of the thumb; a flex cut structure is also arranged at the metacarpophalangeal joint of the thumb protective layer, which is better adapted to the changes of the curved surface of the metacarpophalangeal joint when it is bent, with good movement flexibility and good protection function in the bending state. An anisotropic flex slit is provided on the first dactylus of the thumb protective layer, which can reduce the restraint of the thumb protective layer when deformed, increase comfort and reduce fatigue.

In the present application, the fingertip part of the universal finger protection layer of the glove is provided with a plurality of full flex cuts to divide the fingertip part into a plurality of partition blocks facing different directions, which can disperse the force applied on the glove in all directions, reduce the direct impact on the fingertip surface and reduce the injury.

In the present application, the protective layer of the back of the hand of the glove has a structure with a plurality of vertical protection blocks and a plurality of flex slits alternately arranged to realize the protection of the hand back, so as to ensure the comfort of clenching fist and meet the impact protection requirements of the hand back part.

In the application, the finger protective layer and the hand back protective layer are integrated as a whole through the bottom layer, which meets the requirements of the strength of impact protection, and is convenient to fix the anti-impact protection layer on the glove body, and is convenient for production and processing.

The above is only a general description of the technical solution of the application. In order to understand the technical means of the present application more clearly, so as to implement according to the contents of the description, the following detailed description of preferred embodiments of the present application with reference to the attached drawings is provided. The above and other purposes, features and advantages of the application will become more apparent from the detailed description.

BRIEF DESCRIPTION OF THE DRAWING

In order to more clearly describe the embodiments of the present application or the technical solutions in the prior art, a brief description regarding the drawings for the embodiments is provided. Obviously, these drawings are only some embodiments of the present application. For those skilled in the art, other embodiments can be obtained from these drawings without creative work. In all drawings, similar elements or parts are generally identified by similar reference signs. In the drawings, the elements or parts are not necessarily drawn to the actual scale.

101-thumb protective layer, 102—universal finger protective layer, 20—flex slit, 201—anti—split rim, 30—flex cut structure, 301—full flex cut, 302—half flex cut, 303—detail cut, 304—universal finger vertical groove, 40—hand back protective layer, 401—vertical protection block, 50—bottom layer, 501—wiring track, 502—inclined surface, 600—honeycomb mesh structure.

THE MODE OF CARRYING OUT THE INVENTION

In order to make the purpose, technical scheme and advantages of the embodiment of the present application clearer, the embodiments of the application will be described clearly and completely in combination with the drawings. Obviously, the described embodiments are part of the embodiments of the application, rather than all the embodiments. In the following description, specific details such as specific configurations and components are provided only to help fully understand the embodiments of the present application. Therefore, it should be obvious to those skilled in the art that various changes and modifications can be made to the embodiments described herein without departing from the scope and spirit of the present application. In addition, in order to be clear and concise, the description of known functions and structures is omitted in the embodiments.

It should be understood that "an embodiment" or "this embodiment" mentioned throughout the description means that the specific features, structures or properties related to the embodiments are included in at least one embodiment of the present application. Therefore, "an embodiment" or "this embodiment" appearing throughout the specification may not necessarily refer to the same embodiment. In addition, these specific features, structures or properties may be combined in one or more embodiments in any suitable manner.

In addition, the similar elements or parts are assigned the same reference numbers and/or letters in different embodiments of the present application. This repetition is for the purpose of simplification and clarity and does not in itself indicate the relationship between the various embodiments and/or configuration. It should also be noted that the terms "including", "comprising", "containing" or any other variation thereof are intended to cover non-exclusive inclusion.

Figure 1:
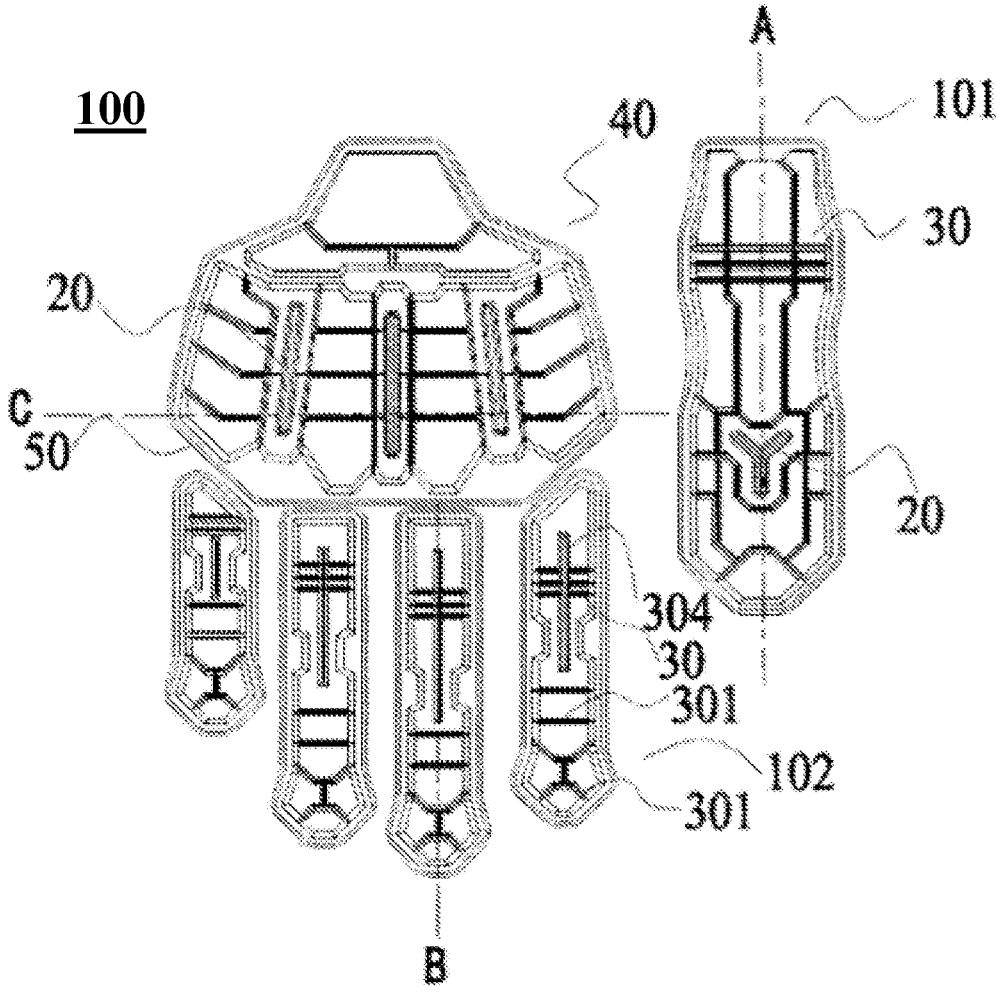
FIGS. 1-2 are a schematic structural view of anti-impact gloves provided by an embodiment of the present application.
Figure 2:
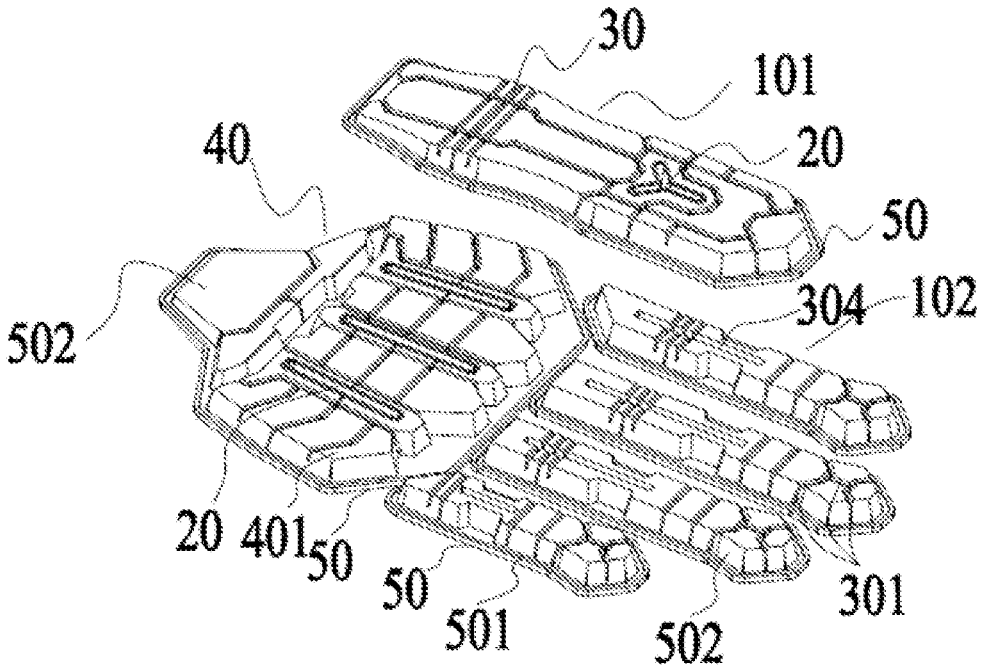

As shown in FIG. 1 and FIG. 2, the present application discloses anti-impact gloves, which comprises a glove body 100 and an anti-impact protective layer arranged on the back of the glove body, wherein the glove body is knitted by a common cut-resistant wrapped yarn, which is made of Ultra-high Molecular Weight Polyethylene (UHMWPE), glass fiber and nylon. A dipping layer is coated on the palm surface of the glove body 100 of the anti-impact gloves, so as to increase the friction force with the contact object. The dipping layer can be formed from nitrile rubber, polyurethane (PU) or natural latex. The back of the glove body 100 is provided with an anti-impact protection layer, which comprises a finger protection layer, a hand back protection layer 40 and a bottom layer 50 arranged at the bottom end of the finger protection layer and the hand back protection layer 40.

Figure 3:
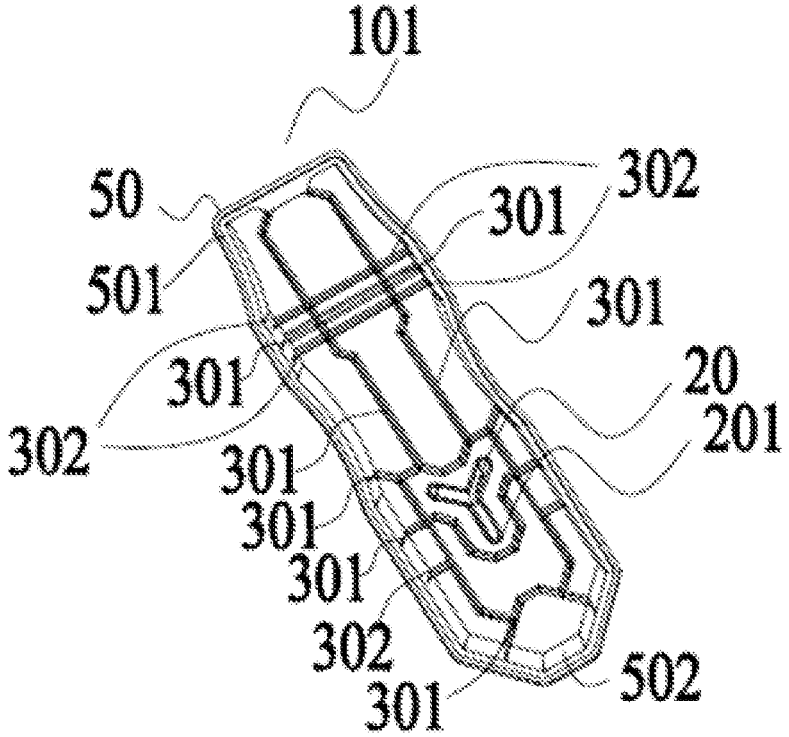
FIG. 3 is a schematic structural view of a thumb protection layer provided by an embodiment of the present application.
Figure 4:
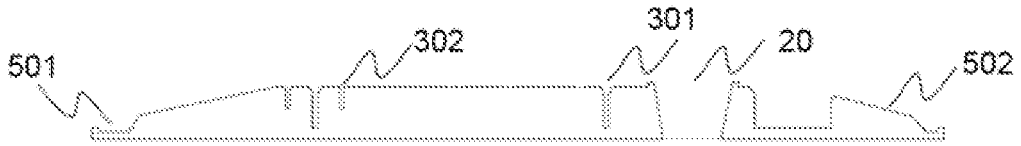
FIG. 4 is a cross-sectional view of a thumb protection layer along section A according to an embodiment of the present application.

As shown in FIGS. 1 and 2, the described finger protective layer comprises a thumb protective layer 101 and four universal finger protective layers 102. As shown in FIG. 3, the described thumb protective layer 101 covers the thumb part and extends to the thumb metacarpophalangeal joint on the back of the glove body 100. In some embodiments, the thumb protective layer 101 extends to 20-25 mm beyond the metacarpophalangeal joint of the thumb. When the metacarpophalangeal joint is bent, the thumb protective layer 101 can protect the protruding metacarpophalangeal joint from external force impact, thus realizing the full coverage protection of the thumb. Due to the long protective surface of the thumb, a flex cut structure 30 is provided at the position of the metacarpophalangeal joint, so that the metacarpophalangeal joint can bend freely. The flex cut structure 30 includes two transversely arranged half flex cuts 302 and a full flex cut 301 arranged between the two half flex cuts 302. It can be seen from the sectional view of the middle axial plane of the thumb in FIG. 4 that the full flex cut 301 extends downward from the top of the thumb protective layer 101, and the depth of the full flex cut 301 equals to the thickness of the thumb protection layer 101 at the corresponding position, and in some other embodiments, the depth of the full flex cut 301 may be slightly less than the thickness of the thumb protective layer 101 at the corresponding position. It can be seen from the Figures that the depth of the half flex cut 302 on the thumb protective layer 101 is less than that of the full flex cut 301, and is close to half of the thickness of the thumb protective layer 101 at the corresponding position. By setting up a deep and shallow staggered flex cut structure at the metacarpophalangeal joint, it can better adapt to the changes of the curved surface when the joint is bent, which not only ensures the protection function of the hand fingers under the bending state, but also ensures the flexibility of the finger movement.

Referring to FIG. 3, a "Y-shaped" flex slit 20 is arranged on the first dactylus of the thumb protective layer 101 near the first knuckle. The flex slit 20 is a V-shaped structure with a wide top and a narrow bottom, and the flex slit 20 penetrates the anti-impact protection layer at the corresponding position. The "Y-shaped" flex slit 20 can reduce the constraint caused by the width and thickness of the thumb protective layer 101 during deep bending. The "Y-type" flex slit 20 can improve the deformation ability of the thumb protective layer 101 along the finger dactylus surface, increase the use comfort and reduce the fatigue feeling. An anti-split rim 201 is provided on the periphery of the "Y-shaped" flex slit 20, so as to make the structure of the "Y-shaped" flex slit 20 more firm. In order to further improve the comfort, a plurality of full flex cuts 301 are arranged on the periphery of the Y-shaped flex slit 20, along the length direction of the thumb protective layer 101 and the fingertip part, and a full flex cut 301 and a half flex cut 302 are arranged at lateral intervals at the first knuckle of the thumb to adapt to the bending of the first knuckle. The full flex cuts 301 and the half flex cuts 302 on the thumb protective layer 101 are symmetrical with each other along the central axis.

In addition, the "Y-shaped" flex slit 20 on the first dactylus of the thumb protective layer 101 near the first knuckle in this embodiment can also be "X-shaped", "cross shaped" or "UK-flag shaped" or other scattered anisotropic flex slits 20, which can also reduce the restraint caused by the width and thickness of the thumb protective layer 101 in the deep bending process, improve the deformation ability of the thumb protective layer 101 along the dactylus surface, increase the use comfort and reduce the fatigue feeling.

Figure 5:
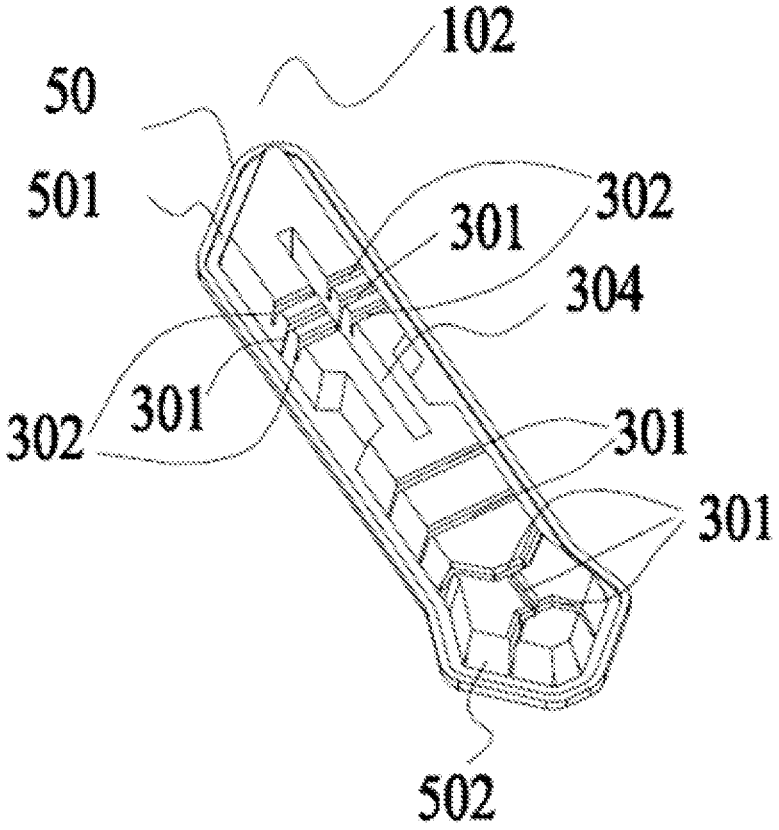
FIG. 5 is a schematic structural view of a universal finger protection layer provided by an embodiment of the present application.
Figure 6:
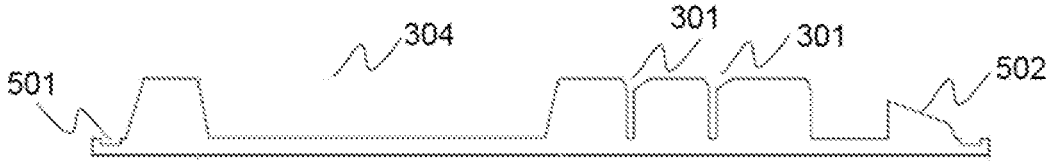
FIG. 6 is a cross-sectional view of a universal finger protection layer along section B according to an embodiment of the present application.

In this embodiment, the finger protection layer comprises four universal finger protection layers 102, each of which covers other finger part except the thumb and adapts to the corresponding finger shape. As shown in FIGS. 5 and 6, the fingertip part of each universal finger protection layer 102 is provided with a plurality of full flex cuts 301 to divide the fingertip part into a plurality of partition blocks facing different directions, so that when subjected to external forces, its anisotropic deformation will cause stress dispersion, thus reducing the direct impact on the fingertip surface and reducing damage. As shown in the FIGS., in this embodiment, two broken line full flex cuts 301 are adopted, and in combination with the vertical full flex cuts 301 arranged between the two, the fingertip part is divided into three partition blocks, and each block is respectively oriented in one direction. When the fingertip is impacted by external force, the three partition blocks can disperse the stress to three different directions, thus avoiding the concentrated stress and reducing the impact. It should be noted that the full flex cut 301 at the fingertip is not limited to broken line and straight line, but also can be arc-shaped and other applicable lines. In order to facilitate the bending of the first knuckle and the second knuckle, two full flex cuts 301 are arranged transversely at the first knuckle of each universal finger protective layer 102, the flex cut structure 30 is provided at the second knuckle, and a long strip-shaped full flex cut 301 is arranged in the direction extending from the place close to the first knuckle to the back of the hand. The flex cut structure 30 can be referred to the description above about the flex cut structure 30, which will not be detailed here.

Continuing to refer to FIGS. 5 and 6, in some embodiments, the finger back of the universal finger protection layer 102 is also provided with a universal finger vertical groove 304, the depth of the universal finger vertical groove 304 is equal to or less than the thickness of the finger protective layer at the corresponding position. The universal finger vertical groove 304 can improve the bending rigidity of the anti-impact protective layer at the finger part and provide bending comfort.

Figure 7:
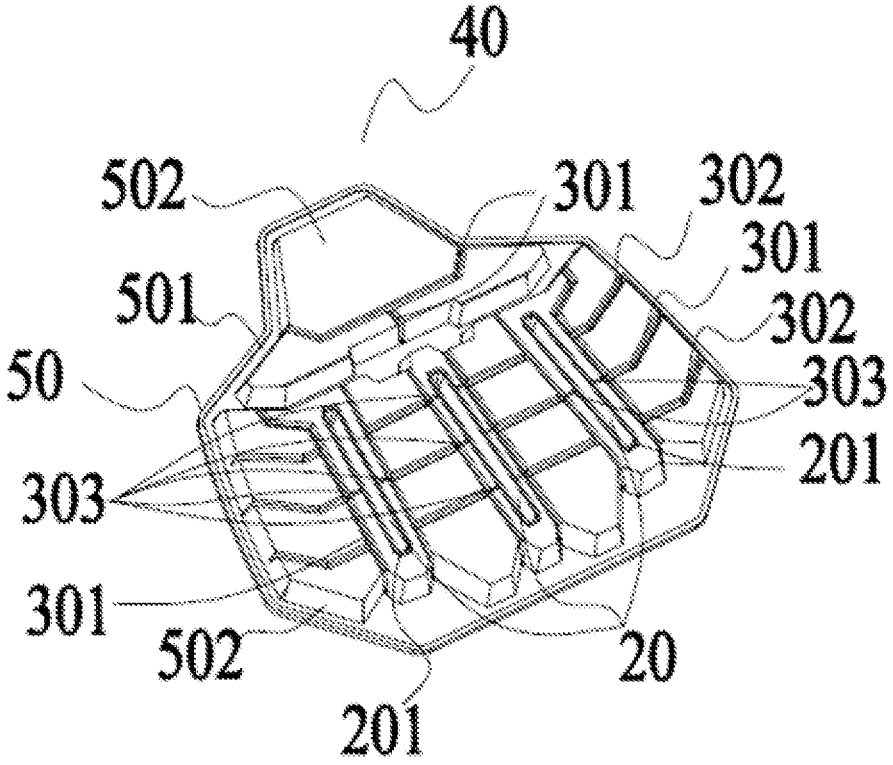
FIG. 7 is a schematic structural view of a hand back protective layer provided by an embodiment of the present application.
Figure 8:
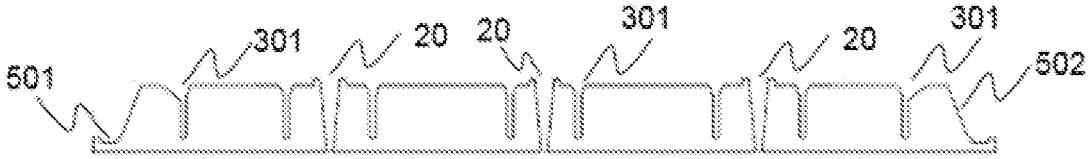
FIG. 8 is a cross-sectional view of a hand back protective layer along the section C provided by an embodiment of the present application.

As shown in FIGS. 7 and 8, the hand back protective layer 40 disposed on the hand back part comprises four vertical protection blocks 401 and three long strip-shaped flex slits 20 arranged alternately. Each of the flex slits 20 is distributed between two adjacent metacarpophalangeal joints, and a vertical protection block 401 is sandwiched between every two flex slits, an anti-split rim 201 is arranged around the flex slit 20, which protrudes out of the end face of the anti-impact protective layer, so as to make the structure around the flex slit 20 more firm and not easy to be damaged in the process of frequent expansion. It can be seen from the above that the protective layer 40 of the back of the hand is divided into seven parts through four vertical protection blocks 401 and three flex slits 20. This structural design not only satisfies the comfort of making a fist, but also meets the impact protection requirements of the back of the hand. It should be noted that the number of the vertical protection block 401 and the flex slit 20 on the hand back protective layer 40 is not limited to this, and can be arbitrarily reduced according to the actual area to be protected on the back of the hand.

Further, the vertical protection block 401 has a long strip structure. In order to ensure the contraction of the hand back during the bending of the palm, two half flex cuts 302 are provided laterally spaced apart on the vertical protection block 401, and a full flex cut 301 is arranged between the two half flex cuts 302, and a detail cut 303 is arranged between a part of the half flex cuts 302 and the full flex cuts 301 of the vertical protection block 401 and the adjacent flex slit 20, so as to ensure the comfort and reduce the restraint. The depth of the detail cut 303 is less than the depth of the half flex cut 302 on the hand back protective layer 40. It can be seen from the figures that the full flex cut 301, the half flex cut 302 and the detail cut 303 on the hand back protection layer 40 are symmetrical along the central axis in the width direction of the hand back protection layer 40.

As can be seen from FIGS. 1-6, in the present embodiment, there is a wiring track 501 for stitching between the periphery of the bottom layer 50 and the finger protection layer and the hand back protection layer 40. In some embodiments, the bottom layer 50 and the anti-impact protection layer are made of the same material and are integrally molded through the mold. The specific material can be synthetic rubber, PU and natural rubber or PVC. The bottom layer 50 and the anti-impact protective layer can be fixed on the glove body by sewing. In other embodiments, the bottom layer 50 can also be fixed on the glove body by hot pressing or sewing after hot pressing.

Further, the periphery of the thumb protective layer 101, the universal finger protective layer 102 and the hand back protective layer 40, and the sides of the full flex cut 301 and half flex cut 302 are inclined surfaces 502 inclined to the bottom layer 50, so as to disperse the external impact force, and the specific inclination angle is an acute angle less than 90°. In addition, in some embodiments, the width of the full flex cut 301 is 1.5-3 mm, the width of the half flex cut 302 is 1-2 mm, the thickness of the bottom layer 50 is 1-5 mm, and the thickness of the anti-impact protective layer is 3-12 mm.

Figure 9:
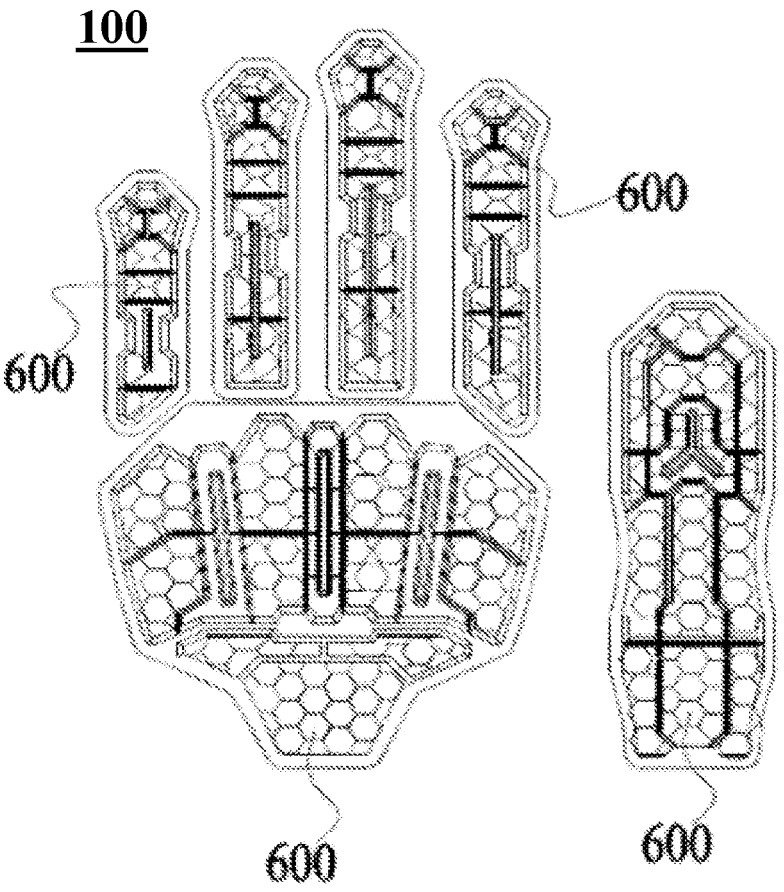
FIG. 9 is a schematic structural view of the contact surface between the bottom layer of the honeycomb mesh structure of anti-impact gloves and the gloves according to an embodiment of the present application.

Further, as shown in FIG. 9, in another embodiment, the bottom layer 50 of the anti-impact glove of the present application is a honeycomb mesh structure. Due to the honeycomb mesh structure, the anti-impact glove can provide reasonable compression space to help buffer and further improve the anti-impact effect.

Experimental Test Part

According to ANSI/ISEA 138, the anti-impact test of the anti-impact gloves of the application is carried out, and the experimental data are shown in Table 1.

TABLE 1 anti-impact test data of anti-impact gloves

| | | TPR/NAME | | | | | |
|---|---|---|---|---|---|---|---|
| | | Present sample 1 | Existing product 1 | Present sample 2 | Existing product 2 | Existing product 3 | Existing product 4 |
| | Style/Sku | | KX43A | KX91V | KX90(sewn) | KX90 (Bonded) | KX93 |
| Finger and thumb (KN) | Thumb | 3.88 | 8.72 | 6.09 | 8.92 | 9.78 | 6.45 |
| | index finger | 3.13 | 8.67 | 5.85 | 8.50 | 11.63 | 5.87 |
| | middle finger | 3.31 | 9.73 | 5.42 | 8.40 | 11.10 | 6.91 |
| | ring finger | 3.30 | 9.63 | 5.72 | 8.18 | 10.76 | 6.44 |
| | pinky | 3.61 | 9.76 | 5.81 | 8.92 | 12.22 | 6.94 |
| | max force | 3.88 | 9.76 | 6.09 | 8.92 | 12.22 | 6.94 |
| | average force | 3.45 | 9.30 | 5.78 | 8.58 | 11.10 | 6.52 |
| | level | 3 | 0 | 2 | 1 | 0 | 1 |
| knuckle of hand back (KN) | 1 index finger | 3.34 | 10.16 | 5.71 | 9.33 | 11.41 | 6.78 |
| | 2 middle finger | 3.53 | 10.40 | 5.91 | 9.78 | 10.99 | 7.00 |
| | 3 ring finger | 3.55 | 10.53 | 6.03 | 9.48 | 12.23 | 9.60 |
| | 4 pinky | 3.47 | 10.23 | 6.04 | 8.27 | 12.26 | 7.76 |
| | max force | 3.55 | 10.53 | 6.04 | 9.78 | 12.26 | 9.60 |
| | average force | 3.47 | 10.33 | 5.92 | 9.22 | 11.72 | 7.79 |
| | level | 3 | 0 | 2 | 0 | 0 | 1 |
| final result(level) | | 3 | 0 | 2 | 0 | 0 | 1 |

TABLE 2 classification of impact resistance level

| Level | Average (KN) | Total impact resistance (KN) |
|---|---|---|
| 1 | ≤9 | ≤11.3 |
| 2 | ≤6.5 | ≤8.1 |
| 3 | ≤4 | ≤5 |

Sample 1 of the present application is a test sample of one of the embodiments in which the bottom layer 50 of the anti-impact glove in the above-mentioned embodiment of the application has a honeycomb mesh structure, and sample 2 of the present application is a test sample of one of the embodiments in which the bottom layer 50 of the anti-impact glove in the above-mentioned embodiment of the present application has a non-honeycomb mesh structure.

It can be seen from table 1 that in the test results of sample 1 of the present application, the average impact value of the finger part is 3.45 KN, and the maximum value is 3.88 KN. From the impact data of the hand back joint part, the average value is 3.47 KN, and the maximum value is 3.55 KN. Referring to the evaluation standard in Table 2, it is determined as level 3. The anti-impact rating of the whole glove can also reach level 3, and the anti-impact performance is the best. Moreover, because the bottom layer 50 of the anti-impact protection layer is honeycomb mesh structure, the anti-impact effect of the glove exceeds that of sample 2 of the present application.

In the test results of sample 2 of the present application, the average impact value of the finger part is 5.78 KN, and the maximum value is 6.09 KN. It can be seen from the impact data of the hand back joint part that the average value is 5.92 KN and the maximum value is 6.04 KN. According to the evaluation standard in Table 2, it is determined as level 2. On the whole, the overall anti-impact rating of the glove can reach level 2, and the glove with the structure of the embodiment has excellent anti-impact performance.

However, the impact resistance of both the finger part and the hand back part in existing products is not good. As shown in Table 1, for the test data of existing product 1, the average value of the impact force test of the finger part is 9.30 KN, and the average value of the hand back is 10.33 KN. According to the rating standard in Table 2, the evaluation is level 0. Therefore, the final rating result of the gloves of existing product is level 0, and the anti-impact effect of other existing products cannot be compared with the sample of the present application.

In summary, the back of the anti-impact gloves in the present application is provided with an anti-impact protective layer, which can reduce the external impact force. According to the shape and activity law of each finger, a finger protection layer corresponding to the corresponding finger is set, which not only protects the finger in all directions, but also ensures the free movement of the finger.

The above description of all the embodiments has been disclosed to enables those skilled in the art to realize or use the present application. Various modifications to these embodiments will be apparent to those skilled in the art, and the general principles defined herein may be implemented in other embodiments without departing from the spirit or scope of the present application. Therefore, the present application will not be limited to the embodiments shown herein, but fall within the widest range consistent with the principles and novel features disclosed herein.

The invention claimed is:

1. An anti-impact glove, comprising a glove body and an anti-impact protective layer arranged on a back of the glove body, characterized in that the anti-impact protective layer includes:

a finger protective layer, which comprises a thumb protective layer and a plurality of universal finger protective layers; wherein the thumb protective layer covers a thumb part on the back of the glove body and is configured to extend above the thumb metacarpophalangeal joint of a wearer, an anisotropic flex slit is arranged on a first dactylus of the thumb protective layer near the first knuckle, and a flex cut structure is provided at the metacarpophalangeal joint of the thumb protection layer to adapt to the flexion of the metacarpophalangeal joint;

the plurality of universal finger protective layers, respectively covered on other finger parts except the thumb and adapted to the corresponding finger shape, wherein a fingertip part of each universal finger protection layer is provided with a plurality of full flex cuts to divide the fingertip part into a plurality of partition blocks facing different directions;

a hand back protective layer, arranged on a hand back part of the back of the glove body and including a plurality of vertical protection blocks and a plurality of long strip-shaped flex slits arranged alternately, each of the long strip-shaped flex slits is distributed between two adjacent metacarpophalangeal joints;

a bottom layer disposed below the finger protective layer and the hand back protective layer and fixed on the back of the glove body.

2. The anti-impact glove according to claim 1, wherein the flex slit is a V-shaped structure with a wide top and a narrow bottom, and the flex slit penetrates the anti-impact protective layer at a corresponding position.

3. The anti-impact glove according to claim 1, wherein the flex cut structure contains two half flex cuts arranged at lateral intervals and a full flex cut positioned between the two half flex cuts.

4. The anti-impact glove according to claim 3, wherein two full flex cuts are arranged transversely at the first knuckle of the universal finger protective layer, the flex cut structure is provided at the second knuckle, and a long strip-shaped full flex cut is arranged in the direction extending from the vicinity of the first knuckle to the hand back.

5. The anti-impact glove according to claim 1, wherein the anisotropic flex slit is in the shape of a "Y-shaped", "X-shaped", "cross-shaped" or "UK-flag shaped".

6. The anti-impact glove according to claim 1, wherein the plurality of vertical protection blocks is of long strip structure, and two half flex cuts are horizontally spaced on the vertical protection block, and a full flex cut is arranged between the two half flex cuts.

7. The anti-impact glove according to claim 6, wherein a detail cut is optionally arranged between the half flex cut and the full flex cut of the vertical protection block and the adjacent flex slit.

8. The anti-impact glove according to claim 7, wherein the full flex cut, the half flex cut and the detail cut extend downward from the top of the anti-impact protective layer, the depth of the full flex cut is equal to or less than the thickness of the finger protective layer or the hand back protective layer at the corresponding position, and the depth of the half flex cut is less than that of the corresponding full flex cut- and greater than that of the corresponding detail cut.

9. The anti-impact glove according to any one of claim 1, wherein an anti-split rim is arranged on a periphery of the flex slit, and the anti-split rim protrudes from an end face of the anti-impact protective layer.

10. The anti-impact glove according to claim 1, wherein the periphery of the thumb protective layer, the universal finger protection layer and the hand back protective layer, and side edges of the full flex cut and the half flex cut are a slope inclined to the bottom layer; and a wiring track for stitching is provided between the periphery of the bottom layer with the finger protection layer and the hand back protective layer.

11. The anti-impact glove according to claim 10, wherein the bottom layer is a honeycomb mesh structure.

* * * * *